US011827478B2

(12) United States Patent
Delley et al.

(10) Patent No.: US 11,827,478 B2
(45) Date of Patent: Nov. 28, 2023

(54) SUCTION BRAKE, SHEET CONVEYOR WITH SUCH SUCTION BRAKE AND METHOD OF APPLYING A RETARDATION FORCE TO A MOVING SHEET OF MATERIAL

(71) Applicant: BOBST MEX SA, Mex (CH)

(72) Inventors: Yann Delley, Chapelle-sur-Moudon (CH); Steven Stojanovic-Roth, Nax (CH); Jean-Claude Rebeaud, Le Mont-sur-Lausanne (CH)

(73) Assignee: BOBST MEX SA, Mex (CH)

( * ) Notice: Subject to any disclaimer, the term of this patent is extended or adjusted under 35 U.S.C. 154(b) by 0 days.

(21) Appl. No.: 17/596,117

(22) PCT Filed: Jun. 2, 2020

(86) PCT No.: PCT/EP2020/065218
§ 371 (c)(1),
(2) Date: Dec. 3, 2021

(87) PCT Pub. No.: WO2020/245116
PCT Pub. Date: Dec. 10, 2020

(65) Prior Publication Data

US 2022/0242688 A1 Aug. 4, 2022

(30) Foreign Application Priority Data

Jun. 5, 2019 (EP) ..... 19020363

(51) Int. Cl.
*B65H 29/68* (2006.01)

(52) U.S. Cl.
CPC ... *B65H 29/686* (2013.01); *B65H 2406/3661* (2013.01); *B65H 2406/411* (2013.01); *B65H 2701/1313* (2013.01)

(58) Field of Classification Search
CPC ..... B65H 29/686; B65H 2406/3661; B65H 2406/411; B65H 2701/1313
See application file for complete search history.

(56) References Cited

U.S. PATENT DOCUMENTS 3,659,839 A 5/1972 Baucke
3,933,351 A * 1/1976 Mayer ..... B65H 5/228 271/204

(Continued)

FOREIGN PATENT DOCUMENTS

EP 1935820 A2 6/2008
GB 2323837 A * 10/1998 ..... B65H 29/12

(Continued)

OTHER PUBLICATIONS

International Search Report dated Aug. 5, 2020 in International Appliation No. PCT/EP2020/065218 (4 pages).

*Primary Examiner* — Luis A Gonzalez
(74) *Attorney, Agent, or Firm* — Bookoff McAndrews, PLLC

(57) ABSTRACT

The invention relates to a suction brake for use with a sheet conveyor configured to convey a succession of flat elements in sheet form along a conveying path between a first location and a second location, the suction brake comprising:

a hollow body having an interior cavity and a face that defines a plurality of suction apertures that communicate with the interior cavity;

an obturator arrangement coupled to the hollow body and moveable with respect to the suction apertures;

the obturator arrangement being moveable between an open position, in which the obturator arrangement exposes the suction apertures to a maximum extent, and a restricted position, in which the obturator arrangement occludes the suction apertures to a maximum (Continued)

extent. The obturator may rotate or be linearly translated in moving between the open and restricted positions.

19 Claims, 5 Drawing Sheets

(56) References Cited

U.S. PATENT DOCUMENTS

| | | | | |
|---|---|---|---|---|
| 4,173,301 | A | 11/1979 | Turini et al. | |
| 7,137,750 | B2 * | 11/2006 | Fujioka | B41J 29/13 400/648 |
| 9,027,473 | B2 | 5/2015 | Fornay | |
| 9,193,554 | B2 * | 11/2015 | Ansermot | B65H 29/686 |
| 2018/0222707 | A1 * | 8/2018 | Chatry | B65H 29/686 |

FOREIGN PATENT DOCUMENTS

| | | | |
|---|---|---|---|
| JP | S48-016122 | B | 5/1973 |
| JP | S53-104073 | A | 9/1978 |
| JP | H05-016569 | A | 1/1993 |
| JP | H09-067055 | A | 3/1997 |
| JP | 2013-514201 | A | 4/2013 |
| SU | 343879 | A1 | 7/1972 |
| SU | 835924 | A1 | 6/1981 |
| TW | 201127640 | A | 8/2011 |

* cited by examiner

SUCTION BRAKE, SHEET CONVEYOR WITH SUCH SUCTION BRAKE AND METHOD OF APPLYING A RETARDATION FORCE TO A MOVING SHEET OF MATERIAL

CROSS-REFERENCE TO RELATED APPLICATION(S)

This application is a National Stage under 35 U.S.C. § 371 of International Application No. PCT/EP2020/065218, filed on Jun. 2, 2020, which claims priority to European Patent Application No. 19020363.8, filed Jun. 5, 2019, the contents of all of which are incorporated by reference in their entirety.

The present invention relates to a suction brake for use with a sheet conveyor, to a sheet conveyor having such suction brake and to a method of applying a retardation force to a moving sheet of material using a suction brake.

The invention finds a particularly advantageous, although not exclusive, application in the field of the manufacture of packaging made of paper or light cardboard.

In the packaging manufacturing industry, packaging is made from a sheet of cardboard generally in several steps. This is why known processing machines of the prior art are traditionally made up of several successive workstations through which each sheet is moved sequentially. In practice, each sheet is conveyed individually from one workstation to another by pulling it via its front edge, typically using what is known as a gripper bar, leaving the rest of the sheet not held in any particular way.

In order for the sheet nonetheless to maintain a certain degree of flatness as it decelerates from the maximal feeding speed on arriving at a workstation, it is known practice to brake its rear portion during the sheet introduction phase by using a suction bed which may be referred to as a suction braking device or suction brake. Installed transversely in close proximity to the entry to the workstation, such a braking device performs its function by restraining the rear portion of the sheet using suction, while at the same time allowing it progressively to slide as its front portion is pulled forward. In particular, when a sheet arrives at a workstation for processing, the gripper bar that is pulling the front edge of the sheet stops to enable the sheet to be processed. The suction brake is used to generate friction between the sheet and a stationary surface, thereby providing a braking effect on the trailing parts of the sheet, so that the inertia of the sheet does not cause the sheet to buckle, crumple or crease. Any or all of the workstations may include a suction brake.

Suction for a suction brake may be provided by using one or more suction pumps to evacuate the interior air/gas of the braking device, thereby resulting in suction at suction apertures of the device. An alternative is a Bernoulli device in which suction is provided using the Venturi effect by forcing gas under pressure within the braking device to accelerate through a restriction. The suction apertures of the braking device communicate with one or more cavities of the device within which the Venturi effect operates. Because the Venturi effect enables localised generation of suction, is energetically very efficient, and because it is easy both to provide a supply of pressurised gas, e.g. compressed air, and to deliver this wherever it is required, in practice the use of a Bernoulli device rather than one relying on an external source of suction is generally preferred.

In operation, a suction brake first sucks out the air between the sheet and an operating surface of the braking device, and then, by pulling the sheet against the operating surface of the device, applies a restraining force to the sheet that serves as a braking force. Ideally the first operation of sucking out the air between the sheet and the operating surface of the braking device is achieved as quickly as possible so as to avoid sheet deformation as the result of sheet inertia. This requires maximum suction. With a Bernoulli device this implies the use of significant amounts of high pressure compressed gas.

In the second stage of operation, the sheet is sucked to the operating surface of the braking device, blocking the suction apertures, and the air flow through the suction apertures drops to zero. The sheet is still decelerating at this stage, and the braking force applied has to be high enough to be able to brake the sheet effectively, avoiding the formation of ripples in the sheet and keeping the sheet flat. Optimal performance, and in particular avoiding sheet distortion, requires the amount of suction at this second stage to be adjusted based on the type of sheet (e.g. the material type of the sheet, and its weight) as well as the cutting shape of the sheet. This means that the pressure and/or volume of gas that is fed to the Bernoulli device needs to be adjusted based on the requirements of this second stage of operation—even though that may conflict with the requirements of the first stage. Applying too high a braking force at this stage of the operation may cause machine interruptions, damage to packaging blanks, etc.

The restrictions in gas pressure/volume required for the second stage of the operation may mean that the first stage of the operation proceeds too slowly, with the consequence that the speed of the transport system and/or the cadence of the processing machine needs to be reduced to reduce the burden on the braking system (by reducing the amount of speed that has to be shed and/or by providing a longer interval for the first stage of the operation to be performed—so that the sucked air flow rate can be lower). Also, with a lower cadence, less sheet deceleration is required, and thus the magnitude of the restraining force required is also reduced. But the disadvantage of this is that there is corresponding reduction in throughput and hence decreased productivity.

It would be desirable if the conflicting demands of the first and second stages of the braking operation could be reconciled without a concomitant reduction in operating speeds and throughput, while avoiding blank damage and machine/production line stoppages.

According to a first aspect, the present invention provides a suction brake for use with a sheet conveyor configured to convey a succession of flat elements in sheet form along a conveying path between a first location and a second location, the suction brake comprising:

- a hollow body having an interior cavity and a face that defines a plurality of suction apertures that communicate with the interior cavity;
- an obturator arrangement coupled to the hollow body and moveable with respect to the suction apertures;
- the obturator arrangement being moveable between an open position, in which the obturator arrangement exposes the suction apertures to a maximum extent, and a restricted position, in which the obturator arrangement occludes the suction apertures to a maximum extent,
- wherein the hollow body comprises a Bernoulli device and the suction orifices are provided by the Bernoulli device.

This aspect of the invention enables the suction experienced by the sheet material during the second stage of the braking process to be regulated independently of the suction force applied during the initial phase. Thus the sucked gas flow rate during the initial phase can be maximised while the degree of suction and hence braking force provided during the second phase can be adjusted and set to the optimum level based on the size, nature and configuration of the sheets being processed.

According to a second aspect, the present invention provides a sheet conveyor system configured to convey a succession of flat elements in sheet form along a conveying path between a first location and a second location, having a suction brake as defined above, the suction brake being arranged to apply a restraining force to trailing edges of flat elements being conveyed by the system.

This aspect of the invention also enables the suction experienced by the sheet material during the second stage of the braking process to be regulated independently of the suction force applied during the initial phase during, for example, a stamping operation. Thus the sucked gas flow rate during the initial phase can be maximised while the degree of suction provided during the second phase can be adjusted and set to the optimum level based on the size, nature and configuration of the sheets being processed.

According to a third aspect, the present invention provides a method of applying a braking force to a moving sheet of material using a suction brake having a suction orifice, the method comprising:

- using the suction orifice to withdraw air from between the sheet of material and a surface of the suction brake; and subsequently
- throttling the suction orifice to reduce a free area of the suction orifice; and
- subsequently using the reduced free area of the suction orifice to continue suction between the sheet and the surface of the suction brake to cause the sheet to adhere to the surface.

This aspect of the invention enables the suction experienced by the sheet material during the second stage of the braking process to be regulated independently of the suction force applied during the initial phase. Thus the sucked gas flow rate during the initial phase can be maximised while the degree of suction provided during the second phase can be adjusted and set to the optimum level based on the size, nature and configuration of the sheets being processed.

According to another aspect, the present invention provides a suction braking device for use with a sheet conveyor configured to convey a succession of flat elements in sheet form along a conveying path between a first location and a second location, the suction braking device comprising:

- a hollow body having an interior cavity and a face that defines a plurality of suction apertures that communicate with the interior cavity;
- a throttling arrangement coupled to the hollow body and moveable with respect to the suction apertures;
- the throttling arrangement being moveable between an open position, in which the throttling arrangement exposes the suction apertures to a maximum extent, and a restricted position, in which the throttling arrangement restricts the suction apertures to a maximum extent.

Embodiments of the invention will now be described, by way of example only, by reference to the accompanying drawings, in which.

In the following description, the same elements have been denoted by identical references. Only those elements that are essential to understand the invention have been depicted, and have been so schematically and not to scale.

Figure 1:
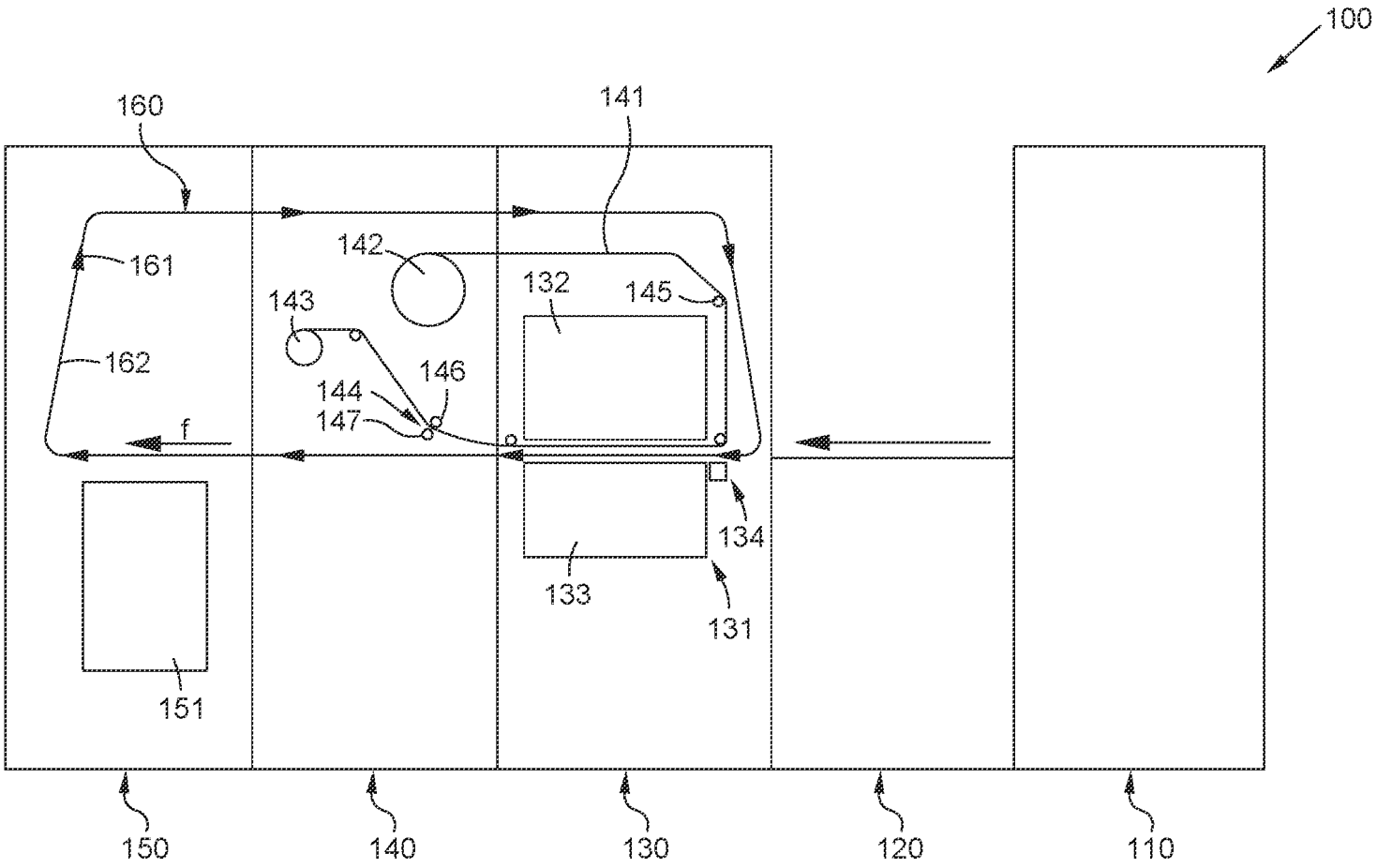
FIG. 1 illustrates a foil stamping machine in which a suction brake according to an embodiment of the invention is incorporated as part of a sheet processing machine.

In order to provide a context within which to describe embodiments of the invention, first a conventional sheet processing machine is described, with which a suction brake according to an embodiment of the invention can be provided. FIG. 1 therefore illustrates a sheet processing machine 100 that uses stamping to customize cardboard packaging intended for the luxury goods industry. Such a processing machine, commonly referred to as a foil stamping machine, is known in the prior art. It will therefore not be described in detail here, either in terms of its structure or in terms of its operation. Moreover, for ease of description and ease of understanding only one station of the sheet processing machine is described as including a suction brake, but the skilled person will understand that more than one station may include a suction brake. Also, of course, although the station described as having a suction brake is a stamping station, suction brakes according to embodiments of the invention find application with other stations of sheet processing machines, for example with a reception area or an ejection area, and are in no way limited to use with stamping stations.

This sheet processing machine 100 is made up in the conventional way of several workstations 110, 120, 130, 140, 150 which are juxtaposed to form a unit assembly capable of processing a succession of flat elements in sheet form. Thus, the entry to the machine comprises a sheet feeder 110, performing the function of feeding the machine, sheet by sheet, from a stack, followed by a feed table 120, on which the sheets are laid out in a stream before repositioning one sheet after the other with precision.

Next is a stamping station 130 which uses a platen press 131 to apply to each sheet, a hot foil stamping, metalized coating which comes from a stamping foil 141. The actual stamping operation itself takes place between an upper platen 132, which is static, and a lower platen 133, which is mounted with the ability to move vertically up and down. A suction brake 134 according to an embodiment of the invention finds particular application in providing a braking and restraining effect to sheets being decelerated for being stamped, as will be described subsequently.

The next module in the machine 100 comprises a foil feed and recovery station 140. The purpose of this station is to deliver the foil 141 which is stored wound around a feed reel 142, then to recover it by winding it around a recovery reel 143 once it has been used after passing through the platen press 131. Between the point at which it is stored and the point at which it is recovered, the foil 141 is driven along by a drive system 144. This system is mainly made up of a series of turn bars 145, which are installed along the path followed in order to guide the movement of the foil 141, and of a combination of a feed shaft 146 and of a press roller 147 which are positioned downstream of said path so that they can pull the foil 141 along.

The sheet processing machine 100 ends with a delivery station 150 in which the sheets, which arrive one after another, are reformatted into a stack 151. To do that, the conveying means 160 which have the task of pulling the sheets individually from the exit from the feed table 120 as far as the delivery station 150 are moreover arranged so that they automatically release each sheet once the latter has come into line with the stack 151 which is in the process of being formed in the delivery station 150. Conventionally, these conveying means 160 use a series of gripper bars 161 which are mounted with the ability to effect a transverse translational movement, via two sets of chains 162 arranged laterally one on each side of the sheet processing machine 100.

Figure 2:
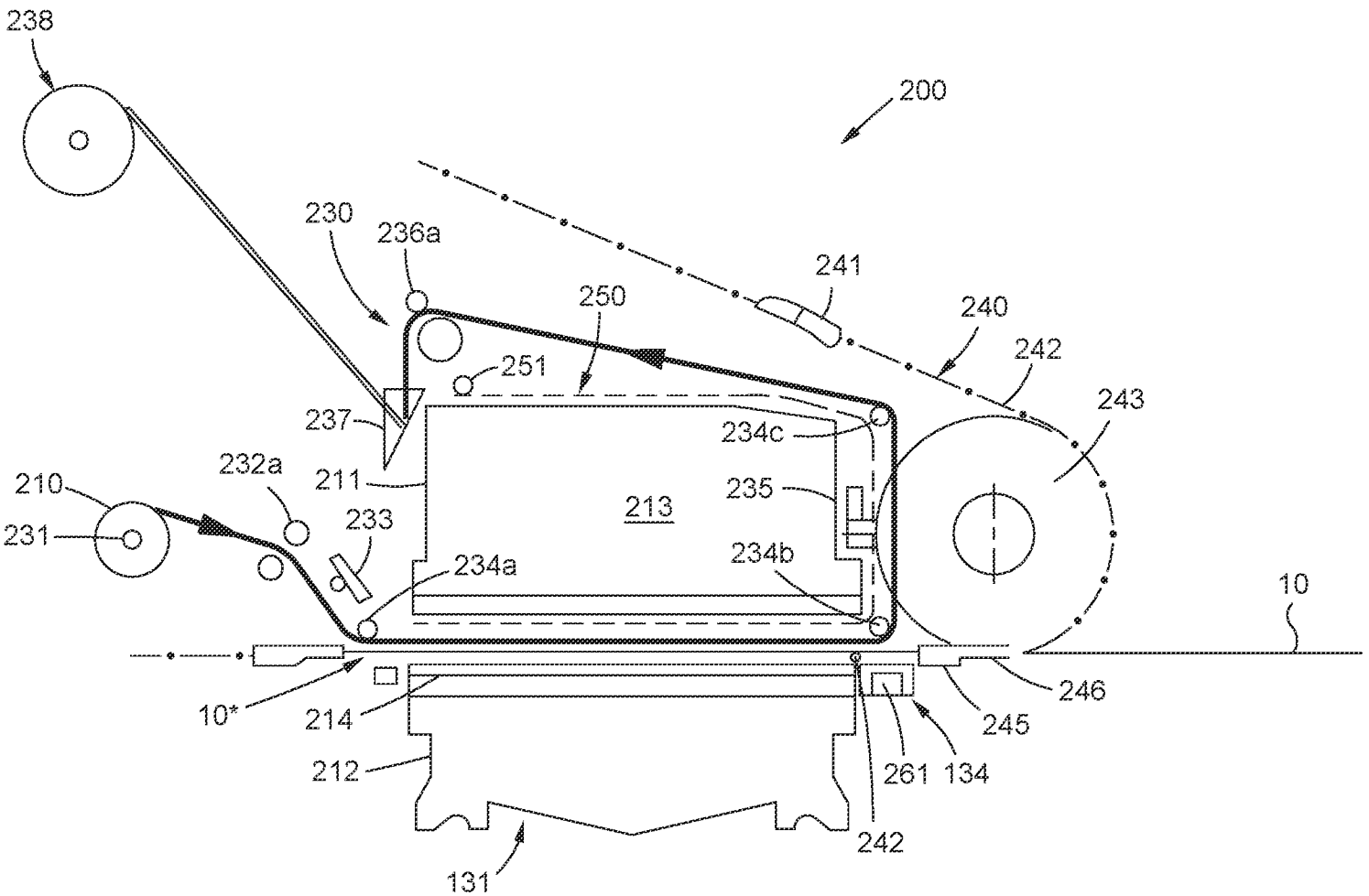
FIG. 2 shows, in detail, the sheet processing machine with which the foil stamping machine shown in FIG. 1 is provided.

FIG. 2 illustrates a similar foil stamping machine 200 to the one illustrated more schematically as 130 and 140 in FIG. 1. In this stamping machine 200, the foil in the foil feed and recovery station 140 passes through the machine in the opposite direction to the passage of the sheets being stamped (unlike in FIG. 1)—either direction being equally useable. The stamping machine 200 is likewise provided with a platen press 131. In this particular embodiment, chosen solely by way of example, stamping is done between a heating upper platen bolster 211 which is fixed, and a lower platen bolster 212 which is mounted so that it can move in a reciprocating vertical movement. The heating upper platen bolster 211 supports a frame 213 under which stamping blocks, not visible here, are fixed, while the lower platen bolster 212 carries a stamping plate 214 to which stamping counterparts, likewise not visible, are attached.

The foil stamping machine 200 is also provided with unwinding means 230 to feed the platen press 131 with stamping foil 141 which is in the form of a strip. As is conventional, these unwinding means 230 comprise a reel holder 231 with respect to which a reel 210 of stamping foil is mounted so that it can rotate, a feed shaft associated with press rollers 232*a*, a mark detector 233, a series of return shafts 234 *a*, 234 *b*, 234 *c*, a strip breakage monitor 235, a tensioning shaft associated with press rollers 236*a*, a strip return 237, and a recovery roller 238.

To supplement these unwinding means 230, introduction means 250 are also provided to position the stamping foil 141, and in particular to cause it to pass through the platen press 131. To do that, the introduction means 250 have a loader bar 251 which is mounted transversally mobile in translational movement between the two platen bolsters 211, 212 and, more generally, about the heating upper platen bolster 211. Just like the strip unwinding means 230, the sheet introduction means 250, are conventional.

Finally, the sheet processing machine 100 comprises a transport arrangement 240 allowing each sheet 10 to be moved individually from the exit of the feed table 120 as far as the delivery station 150, including into the platen press 131. The position of a sheet within the sheet processing machine, that effectively defines the conveying path of a sheet through the sheet processing machine, is indicated by the reference 10* in FIG. 2. It will be seen that the sheet 10* is positioned between the upper and lower platen bolsters 211 and 212.

As can be seen, the transport arrangement 240 use a series of gripper bars 241 which are mounted with the ability to move transversally in translational movement via two sets of chains 242 positioned laterally on each side of the foil stamping machine. Each set of chains 242 runs in a loop which allows the gripper bars 241 to follow a path that passes in succession via the platen press 131, the feed and recovery station 140 and the delivery station 150.

In concrete terms, each gripper bar 241 performs an outbound path in a horizontal passage plane between a drive sprocket 243 and a return sprocket, then a return path guided by rollers (not visible) in the upper part of the foil stamping machine. Once it has returned to the vicinity of the drive sprocket 243, each gripper bar 241 is then capable of taking hold of a new sheet 10 as shown in FIG. 2.

FIG. 2 also shows that each gripper bar 241 consists of a transverse bar 245 on which a plurality of grippers 246 are mounted, the grippers being designed so that they can take hold of the front edge of one and the same sheet 10 simultaneously. It will also be noted that each gripper bar 241 is coupled to the two sets of chains 242 via the two respective ends of its transverse bar 245.

The sheet processing machine 100 further comprises a suction brake 134, according to an embodiment of the invention, that is able to partially restrain each sheet 10 by its rear portion, and do so during the phase of introduction of the sheet 10 into the platen press 131. The suction brake 134 is able to hold the rear portion of each sheet 10 roughly in the plane of travel of its front edge, during the phase of introduction of said sheet 10 into the platen press 131.

The suction brake 134 comprises a suction member 261 which is positioned upstream of the platen press 131, and which is capable of collaborating through sliding contact with the rear portion of each sheet 10 being introduced into said platen press 131. Associated with the face of the suction brake 134 is an obturator arrangement 262 that will come into contact with the sheet 10 and which is operable to provide a throttling action to suction orifices, not shown, in the suction member. The function and operation of the obturator arrangement 262 will be described in more detail with reference to FIGS. 3 and 4.

According to a preferred embodiment of the invention, the suction member 261 is fixed, and is positioned as close as possible to the path followed by the front edge of each sheet 10 just before it is actually introduced into the platen press 131. Such a layout specifically allows the suction member 261 to be systematically in contact with any sheet 10 being introduced into the platen press 131. It also has the advantage of guaranteeing that the sheet is positioned roughly parallel to the internal faces of the platen bolsters 211, 212.

In this exemplary embodiment, each sheet 10 is pulled by a gripper bar 241 as it is introduced into the platen press 131. In concrete terms what this means is that the suction brake 134 is positioned in the direct vicinity of the path followed by said gripper bar 241 as it approaches the platen press 131.

However, according to an alternative form of embodiment that has not been depicted, the suction brake 134 could also be mounted such that it is able to move between an active position and a passive position. The assembly would then be arranged in such a way that, in the active position, the suction brake 134 was positioned as close as possible to the path followed by the front edge of each sheet 10 just before it is introduced into the platen press 131, and so that, in the passive position, it is positioned some distance away from said path. Of course, the sheet processing machine 100 would then comprise means capable of moving the suction member 134 from the passive position into the active position when the sheet 10 is ready to be introduced into the platen press and, conversely, of moving said suction brake 134 from the active position into the passive position when said sheet 10 is extracted from the platen press.

According to one particular feature of this alternative form of embodiment, with the platen press being capable of stamping each sheet 10 between a fixed platen and a moving platen, the suction brake 134 is secured to the moving platen; said moving platen then forming the means of movement.

According to one embodiment, with the hot stamping of each sheet 10 being performed on a given face, known as the application face, the suction brake 134 is positioned on the opposite side to said application face; said sheet 10 being considered as it approaches the platen press 131. It must nonetheless be understood that it is still entirely possible for the suction brake 134 to be installed on the same side as the application face.

According to a preferred embodiment, the suction brake 134 operates continuously. Be that as it may, it is perfectly conceivable for the suction brake 134 to be operated discontinuously. In such an event, the sheet processing machine 100 will be arranged in such a way that the suction brake 134 is activated as soon as the front edge of a sheet 10 arrives plumb with it and is deactivated as soon as the rear of said sheet 10 is no longer in contact with said suction brake 134.

In a particularly advantageous manner, the suction brake 134 acts over roughly the entire width of each sheet 10 being introduced into the platen press 131.

According to a currently preferred embodiment of the invention, the suction brake 134 is of the Bernoulli type, that is to say is a device provided with at least one suction hole (suction orifice) where a vacuum (arrow f1 in FIG. 3) is created through a Venturi effect, by driving air under pressure through a discharge pipe (arrows f2 in FIG. 3) which communicates laterally with the suction hole and which is provided with a restriction upstream of said suction hole.

Figure 3:
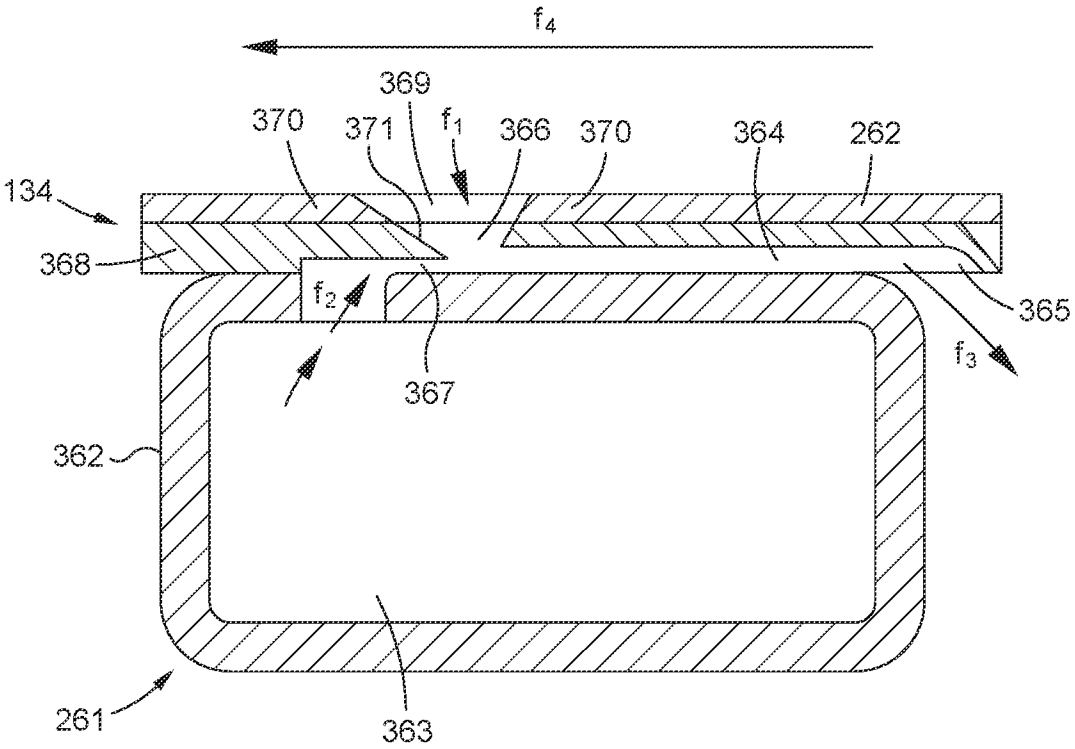
FIG. 3 is a cross section through a suction brake according to an embodiment of the invention.

FIG. 3 shows a cross-section through the suction brake 134. As shown in FIG. 3, the suction brake 134 consists of a tablet 362 through which a main pressurized air supply channel 363 is formed longitudinally and communicates with at least one secondary channel 364 running transversally and opening to the rear of the tablet 362 via an individual discharge orifice 365 (arrow f3). The secondary channel 364 is formed between the upper face (as illustrated) of the main body of the tablet that provides the air supply channel 363, and a secondary element 368, here shown in the form of a plate, that overlies and is attached to the main body. Moreover, each secondary channel 364 on the one hand also communicates with a suction orifice 366 which opens onto the face of the tablet 362 which would, were it not for the presence of obturator arrangement 262, come into contact with each sheet 10 being introduced into the platen press 131. That face is provided by the upper (as illustrated) face of the secondary element 368. Finally, each secondary channel 364 has a restriction 367 positioned just upstream of the suction orifice 366. It is understood here that the terms "longitudinally" and "transversally" mean with respect to the body of the tablet 362, whereas the term "rear" is to be understood in relation to the direction of travel of the sheets 10 (arrow 4), and "upper" is to be understood as towards the path of travel of the sheets.

Preferably, as shown, each discharge orifice 365 is directed in opposition with respect to the platen press 131 and with respect to the plane of travel of each sheet 10 as it approaches the platen press 131. The objective here is for each discharge air flow (arrow f3) to be directed in a direction that does not disturb the attitude of the sheets 10 as they are introduced into the platen press 131.

Also preferably, as shown, each suction orifice 366 has a conical shape opening out toward the outside, notably in the region of its portion 371 closest to the platen press 131. The objective here is to prevent any corner of the front edge of the sheet 10 from entering a suction orifice 366 of the tablet 362 as the sheet 10 approaches the platen press 131.

FIG. 3 also illustrates the provision of an obturator body 262, here in the form of a plate, which enables the selective throttling of the suction orifice 366. As shown, the obturator arrangement is in the form of a plate that lies between the upper face (which might be considered to be the working face) of the secondary element 368 and the path of movement of the sheet 10, the path being shown schematically by the arrow labelled f4.

The obturator body is displaceable with respect to suction orifice 366 between an open position and a restricted position. In the open position, a hole 369 in obturator body 262 is in register with the suction orifice 366. As shown, the hole 369 in the obturator body matches the conical shape of the suction orifice 366. This configuration is optional but if used it can help to avoid loss of suction when the obturator arrangement is fully open, which is desirable.

In order to avoid wasting available suction, it is preferred to provide a seal between the mating surfaces of the obturator element and the cooperating surface of the suction brake, e.g. by providing an O-ring around the rear of the hole 369 in the obturator body, as indicated by 370.

To achieve a throttling effect, the obturator body is moveable with respect to the suction orifice 366 so that the hole 369 moves out of register with the suction orifice, meaning that a portion of the obturator body adjacent the hole 369 starts to occlude the suction orifice 366. Such position is referred to as a restricted position. The greater the relative movement between the obturator body and that part of the suction brake that defines the suction orifice, the greater the degree of throttling and hence the greater the reduction in suction and therefore the braking force experienced by the sheet during the second stage of the braking operation. Accordingly, intermediate position between the open position and the restricted position in which the throttling effect is at a maximum, are possible.

Although FIG. 3 only shows one suction orifice 366 and one hole 369 in the obturator body, those skilled in the art will appreciate that, in practice, suction brakes according to embodiments of the invention may have multiple suction orifices and the obturator arrangement may be configured to enable throttling of all or most of the suction orifices provided.

Having introduced the principle behind the operation of a suction brake according to an embodiment of the invention, further aspects of embodiment of the invention will now be described with reference to FIG. 4.

Figure 4A:
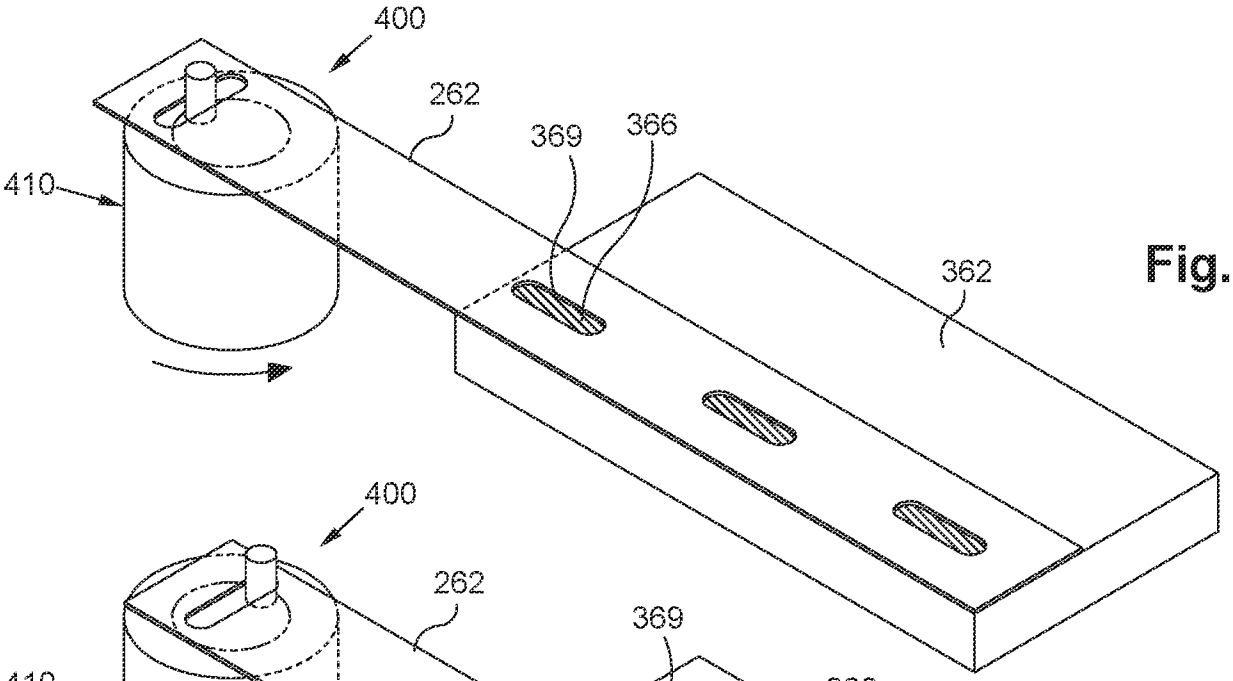
FIG. 4 illustrates schematically the operation of a suction brake according to an embodiment of the invention.
Figure 4B:
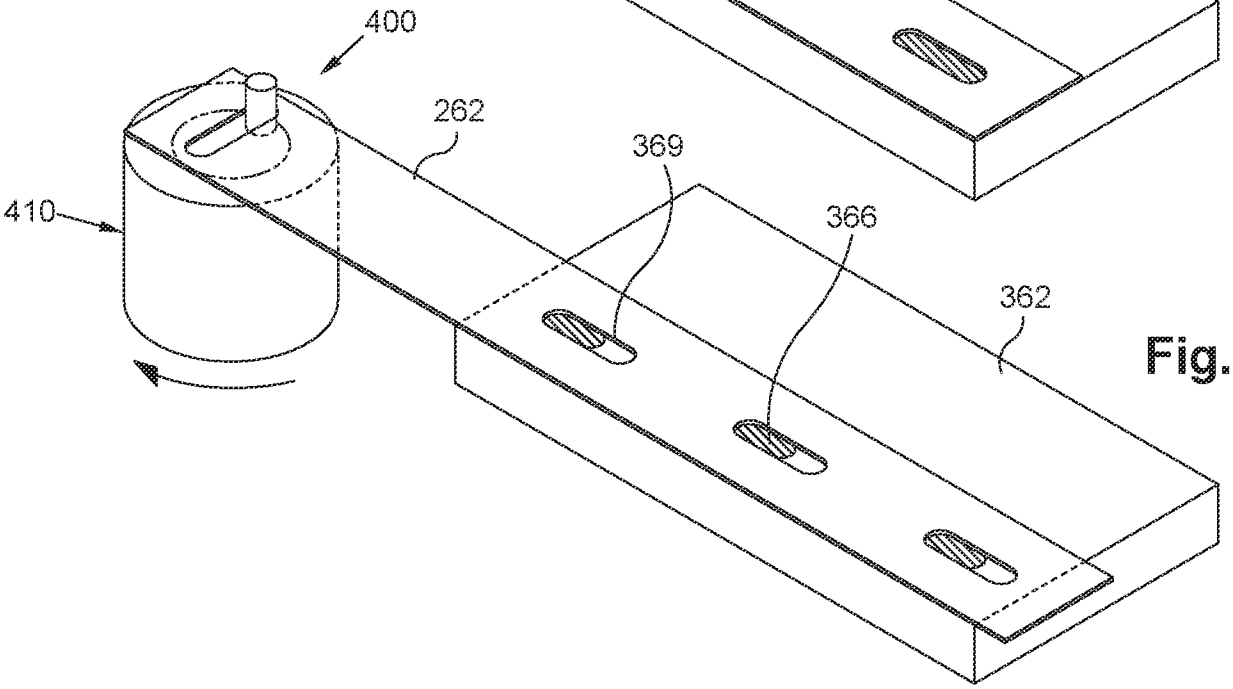

FIGS. 4*a* and 4*b* are perspective views of an embodiment of the suction brake showing a plurality of suction orifices (suction apertures) 366, and a plurality of holes 369 in the obturator body 262. The suction brake includes an obturator arrangement 262 which enables the suction orifices to be selectively throttled to reduce the amount of suction provided. This enables the constraints of the first and second stages of the braking operation to be decoupled, so that high suction can be maintained for the first stage and a suitably lower level of suction provided for the second stage according to the requirements of the sheet being handled. The throttling effect is achieved through relative movement between the obturator arrangement and the suction orifices.

Preferably, the obturator apertures have the same size, and they are regularly spaced so as to achieve an even retarding effect on a sheet.

In FIG. 4, the obturator arrangement comprises the obturator body in the form of a slide 262 having holes 369 spaced and sized to match the openings of the suction orifices 366 in what would otherwise be the sheet-contacting face of the suction brake. FIG. 4*a* shows a first position, the fully open position, in which the holes 369 in the slide fully expose the openings of the suction orifices, so that effective suction provided by the suction brake, for a given supplied gas flow and pressure, is unaffected by the presence of the obturator arrangement. Thus, this fully open position is preferred for use during the first stage of the braking operation. But if less suction is required, for example for the second stage of the braking operation, because of the nature of the sheets being processed, then the obturator arrangement can be adjusted to reduce the effective size of the suction orifices as shown in FIG. 4*b*. With the arrangement as shown in FIG. 4, the obturator arrangement comprises an apertured slide, and this can be moved laterally with respect to the suction orifices. This has the effect of causing the body of the obturator arrangement to occlude the suction apertures, because the apertures in the slide and the suction orifices become (increasingly) misaligned—creating a throttling effect. By adjusting the extent of the movement of the obturator with respect to the suction orifices, the extent of the throttling can be adjusted.

It will be noted that in FIG. 4 the obturator arrangement effectively overlies the hollow body that carries the suction orifices, (although of course the suction brake can be used in different orientations than the one shown, so that, for example, the hollow body could be "flipped" so that the obturator arrangement is positioned beneath the hollow body) so that the obturator is positioned between the hollow body and the path that sheets to be processed will follow. Such an arrangement may be added to an existing design of Bernoulli plate without requiring the interior design of the venture system to be modified. While it may be possible to provide an internal obturator arrangement where suction is provided from an internal venture arrangement, there is clearly greater design freedom to add an internal obturator arrangement in situations where suction is instead provided from an external suction source, such as a vacuum pump.

It will be noted that in FIG. 4 the suction orifices and the apertures in the obturator arrangement are elongate rather than circular. The long axes of these elongate openings are arranged transverse to the feed direction of the sheet material. This enables the area of each suction orifice to be maximised without requiring a significant length of the suction body along the feed direction.

In FIG. 4, a crank arrangement 400 which converts a rotary movement, from a motor 410 for example, into linear movement (translation) of the slide 262 that forms the obturator arrangement. It will be appreciated that if the obturator arrangement is engaged, because of the nature of the sheets being processed, then the obturator arrangement will, during the processing of one sheet, reciprocate from the fully open position of FIG. 4*a* to an obstructive position, as shown in FIG. 4*b*, and then back again to the fully open position ready for the processing of the following sheet.

The use of a crank arrangement 400, as generally shown in FIG. 4, can provide such a reciprocating movement simply and effectively. By using an adjustable, or interchangeable crank, to achieve different crank "throws" the extent of the movement of the obturator arrangement with respect to the suction orifices can be adjusted to suit the characteristics of different sheets being processed.

Instead of using a crank arrangement, the obturator arrangement could be moved with respect to the suction orifices by means of one or more hydraulic or pneumatic rams, or an electrically powered solenoid, all of which directly provide a linear movement suitable for translating, and reciprocating, the obturator arrangement with respect to the suction orifices. These sources of movement also have the advantage of potentially being fast acting and readily controllable both in terms of when movement occurs, but also in terms of their stroke length—so that the extent of the throttling applied to the suction orifices can readily be adjusted and controlled.

It will be appreciated that the obturator arrangement may include a single slide which includes multiple rows of apertures to provide a throttling effect to all of the suction orifices of the suction brake, but may equally comprise more than one slide, each carrying one or more apertures, in for example one or more rows. In the event that multiple slides are provided, these may be coupled to move as one unit, or may be arranged to move separately or grouped to move as separate "banks" of slides. It is also possible to provide an obturator arrangement that effects some only of the suction orifices, As a variant of the arrangement of FIG. 4, rather than providing an apertured body as the, or as an element, of the obturator arrangement, part of the obturator arrangement adjacent a suction orifice may be fixed, with another part being moveable with respect to the fixed part. In such an obturator arrangement an aperture is in effect created by spacing apart the fixed and moveable parts of the obturator, and throttling of a suction orifice by moving the moveable part to overly partially the suction aperture. An obturator arrangement for a suction brake according to such an embodiment of the invention could comprise multiple fixed and moveable parts to provide a throttling effect to the multiple suction orifices of the suction brake.

It will be appreciated that the obturator arrangements described with reference to FIG. 4 may be retrofitted to existing suction brakes, whether their suction is generated using the Bernoulli effect—e.g. Bernoulli plates, or by means of a suction pump. But equally, the principles could be applied to newly created or newly designed suction brakes.

Figure 5:
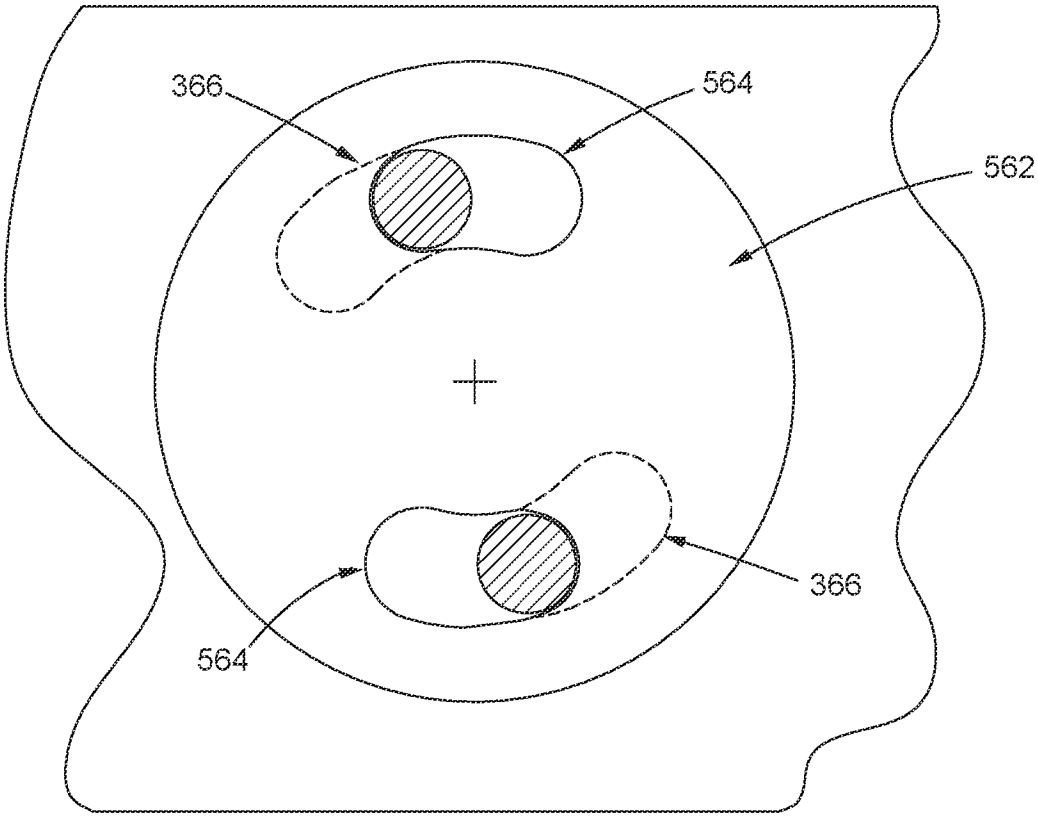
FIG. 5 is a schematic plan view of part of a suction brake according to another embodiment of the invention.

FIG. 5 is a plan schematic view of the face of a suction brake which, in use faces the sheet as it is braked, according to an alternative embodiment of the invention. In this alternative configuration for the obturator arrangement, rather than a simple linear translation between the obturator and the suction orifices a relative rotation occurs. As before, the suction brake comprises a hollow body that defines a cavity, and a face of the hollow body defines the plurality of suction apertures (366) that communicate with the interior cavity. In the example illustrated in the Figure the face that defines the plurality of suction apertures is recessed with respect to the surrounding surface, and the recess receives an obturator element, so that the exposed surface of the obturator element is effectively flush with the surrounding surface of the hollow body.

In the Figure, the obturator element 562 is circular when viewed orthogonally from the sheet feed path, and includes a pair of holes 564 spaced and sized to match the openings of a pair of suction orifices 366. In practice there would generally be multiple obturator elements, and each including one or more apertures to provide throttle control for a similar number of suction orifices. As shown, the circular obturator element is mounted in a corresponding circular recess in the body that provides the suction orifices, with the exposed surface of the obturator element flush with the surrounding surface of the body. In this way, the assembly of the obturator elements and the body provides a sheet-facing surface that is effectively flat, reducing the risk that the surface of the suction brake will damage sheets during processing.

FIG. 5 shows the obturator element 562 rotated with respect to the suction orifices so that the latter are partially throttled with respect to their fully open position. The portions of peripheries of the suction orifices that are concealed by the obturator element 562 are shown as dashed lines, while the useable opening of the suction orifices are shown shaded.

The obturator elements may be displaced (rotated) with respect to the suction apertures by means of a "rack and pinion" arrangement, with part of each obturator element carrying a toothed "pinion" arrangement (preferably provided integrally in the material of the obturator element, for example by machining or by moulding/casting) within the body. With these teeth, a "rack" cooperates—a linear element carrying teeth. Alternatively, a "worm-drive" type of arrangement could be used between a common worm drive shaft and co-operating formations on each of the obturator elements. Another alternative drive arrangement would use a common linear drive shaft that is translated tangentially with respect to each of the obturator elements, with each of the obturator elements including a crank arrangement that converts linear movement of the drive shaft into rotation of the obturator elements.

With suitable design, any of these drive elements can provide a compact and efficient mechanism to produce the required reciprocating arcuate movement of the obturator elements with respect to the suction orifices. As with the sliding obturator arrangement described previously, these "circular" obturator arrangements may be driven by a motor (electrical, pneumatic, hydraulic) or by a linear actuator (solenoid, hydraulic, pneumatic).

It will be appreciated that it may be more difficult to retrofit the obturator arrangements described with reference to FIG. 5 to existing suction brakes than to retrofit those described with reference to FIG. 4.

In order to avoid waste of available suction it is preferred to provide a seal between the obturator element(s) and a co-operating surface with respect to which the obturator element moves—as shown schematically as 370 in FIG. 3.

Whichever obturator arrangement is used, its operation is synchronised with the processing operation being carried out at the processing station with which the suction brake is associated—e.g. with the sheet processing machine for which the suction brake provides a retarding effect to each sheet being processed. In the first stage of the braking operation the obturator arrangement preferably operates at the fully open position, with the obturator being triggered to a throttled (partially obstructing) position at the start of the second stage of the operation. Adjustment of the timing of the starting point for obstruction, and of the degree of obstruction (throttling) applied should be informed by settings that are known to work when using a known suction brake. Where an obturator arrangement is retrofitted to an existing suction brake, known suction settings should provide a very good guide to initial settings.

The invention claimed is:

1. A suction brake for use with a sheet conveyor configured to convey a succession of flat elements in sheet form along a conveying path between a first location and a second location, the suction brake comprising:

a hollow body having an interior cavity and a face that defines a plurality of suction apertures that communicate with the interior cavity; and an obturator arrangement coupled to the hollow body and moveable with respect to the suction apertures;

the obturator arrangement being moveable between an open position, in which the obturator arrangement exposes the suction apertures to a maximum extent, and a restricted position, in which the obturator arrangement occludes the suction apertures to a maximum extent, wherein the hollow body comprises a Bernoulli device and the suction apertures are provided by the Bernoulli device, and wherein the obturator arrangement is configured to undergo rotation when moving between the open and restricted positions.

2. The suction brake of claim 1, wherein the obturator arrangement is positioned between the face of the hollow body and the conveying path of the flat elements.

3. The suction brake of claim 1, wherein for each of the suction apertures the obturator arrangement defines an obturator aperture, and in the open position the obturator aperture fully exposes a corresponding suction aperture.

4. The suction brake of claim 3, wherein in the restricted position the obturator aperture only partially closes the corresponding suction aperture.

5. The suction brake of claim 3, wherein the obturator apertures have a same size.

6. The suction brake of claim 3, wherein the obturator apertures are regularly spaced.

7. The suction brake of claim 1, wherein the obturator arrangement is coupled to a crank arrangement configured to move the obturator arrangement between the open and restricted positions.

8. The suction brake of claim 1, wherein the obturator arrangement is operatively coupled to one or more pneumatic, electric, or hydraulic motors configured and arranged to rotate to move the obturator arrangement between the open and restricted positions.

9. The suction brake of claim 1, wherein the obturator arrangement includes a plurality of elements each configured and arranged to cooperate with a different one of the plurality of the suction apertures.

10. A sheet conveyor system configured to convey a succession of flat elements in sheet form along a conveying path between a first location and a second location, the sheet conveyor system comprising:

the suction brake according to claim 4, the suction braking being arranged to apply a restraining force to trailing edges of flat elements being conveyed by the sheet conveyor system.

11. The sheet conveyor system of claim 10, wherein the sheet conveyor system is arranged to supply the succession of flat elements to a sheet processing device, and the suction brake is arranged to apply the restraining force to flat elements arriving at the sheet processing device.

12. The suction brake of claim 1, wherein the obturator arrangement includes a plurality of holes, that expose and occlude the suction apertures, each hole comprising a hole interior face with a conical profile, and a suction aperture interior face of each of the plurality of suction apertures has a conical profile and matches the conical profile of the hole interior face.

13. The suction brake of claim 12, wherein the conical profile of the suction aperture is narrower at a hollow body end of the suction aperture and wider at an obturator arrangement end of the suction aperture.

14. The suction brake of claim 1, wherein the size of the suction orifices is adjustable.

15. The suction brake of claim 1, wherein the obturator arrangement is interchangeable.

16. A method of applying a retardation force to a moving sheet of material using a suction brake having at least one conical suction orifice, the method comprising:

using the at least one conical suction orifice to withdraw air from between the sheet of material and a surface of the suction brake; and subsequently throttling the at least one conical suction orifice to reduce a free area of the at least one suction orifice; and subsequently using the reduced free area of the at least one conical suction orifice to continue suction between the sheet and the surface of the suction brake to cause the sheet to adhere to the surface.

17. The method of claim 16, wherein the at least one conical suction orifice includes a plurality of suction orifices, and the throttling is applied to each conical suction orifice of the plurality of conical suction orifices.

18. The method of claim 16, wherein the method is applied to moving sheets of material being supplied to a sheet processing device.

19. The method of claim 16, wherein the reduction of the suction is the same over an entire width of the sheet when moving the sheet.

* * * * *